United States Patent [19]

Söderberg

[11] 4,167,083

[45] Sep. 11, 1979

[54] GRINDING MACHINE ADAPTED FOR CHANGING OF GRINDING WHEELS ON A GRINDING SPINDLE

[75] Inventor: Sten T. Söderberg, Lidköping, Sweden

[73] Assignee: Lidkopings Mekaniska Verkstads Aktiebolag, Lidköping, Sweden

[21] Appl. No.: 718,914

[22] Filed: Aug. 30, 1976

Related U.S. Application Data

[63] Continuation of Ser. No. 583,975, Jun. 5, 1975, abandoned.

[30] Foreign Application Priority Data

Jun. 7, 1974 [SE] Sweden ..... 7407501

[51] Int. Cl.[2] ..... B24B 41/04

[52] U.S. Cl. ..... 51/168; 29/432; 29/520; 29/505

[58] Field of Search ..... 51/168; 151/14.5; 403/359, 282; 29/432, 520, 505, 525

[56] References Cited

U.S. PATENT DOCUMENTS

| | | | |
|---|---|---|---|
| 1,833,203 | 11/1931 | Buckley | 51/168 |
| 1,974,150 | 9/1934 | Creveling | 29/520 |
| 3,002,770 | 10/1961 | Chestnut et al. | 85/1 C |
| 3,092,162 | 6/1963 | Johnsen | 29/432 |

FOREIGN PATENT DOCUMENTS

| | | | |
|---|---|---|---|
| 2555613 | 6/1976 | Fed. Rep. of Germany | 51/168 |
| 1160812 | 3/1958 | France | 51/168 |
| 1331527 | 5/1963 | France | 151/14.5 |
| 769607 | 3/1957 | United Kingdom | 51/168 |

*Primary Examiner*—Harold D. Whitehead
*Assistant Examiner*—Roscoe V. Parker
*Attorney, Agent, or Firm*—Daniel M. Rosen

[57] ABSTRACT

Grinding machine adapted for changing of grinding wheels on a grinding spindle bolt of the kind in which the grinding wheel is fixed to the grinding spindle by introducing the spindle bolt in a bushing provided in a centrally located bore in the grinding wheel, and is removed from the spindle bolt by being axially pulled off said spindle bolt, characterized by that the envelope surface of the spindle bolt is provided with at least one ridge, which is arranged in the form of a helix with a great pitch.

12 Claims, 4 Drawing Figures

GRINDING MACHINE ADAPTED FOR CHANGING OF GRINDING WHEELS ON A GRINDING SPINDLE

Figure 1:
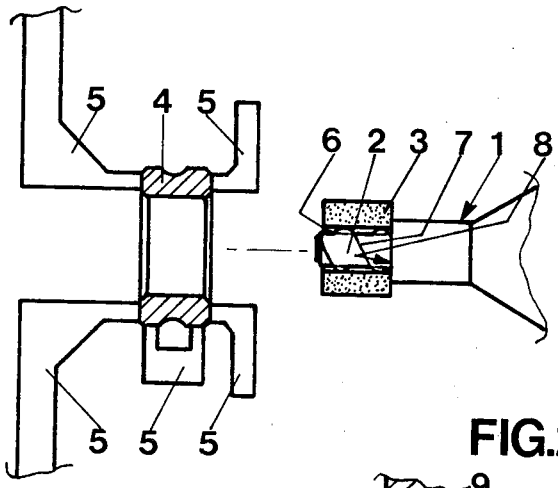

This is a continuation, of application Ser. No. 583,975, filed June 5, 1975 and now abandoned.

THE INVENTION

The present invention relates to a grinding machine adapted for changing of grinding wheels on a grinding spindle of the kind in which the grinding wheel is fixed to the grinding spindle by introducing the spindle bolt in a central bore in the grinding wheel, and the grinding wheel is removed from the spindle bolt by being axially pulled off said spindle bolt.

When mass producing different products, it is of interest to automate the work operations as far as possible, the aim primarily being to improve productivity and to decrease the manpower demand. An example of such a work operation is internal grinding of rings, such as the type of rings for use in rolling bearings. In grinding operations, the grinding wheels must be replaced after some time of use. In order to avoid loss of production to the greatest possible extent, it is desirable to change the grinding wheels as quickly as possible. For this purpose it is previously known, e.g. by the Swedish patent application No. 13570/71 to provide an automatic grinding wheel changing device in connection with an internal grinding machine. Such known grinding wheel changing devices are intended to be used together with grinding wheels with a central bore in which a bushing of a soft metal or similar material is provided. The grinding wheel is, in operation, mounted on a grinding spindle bolt, which is introduced in the bore of the bushing of the grinding wheel with a press fit. In order better to secure the wheel against rotation on the spindle bolt, the spindle bolt may be provided with a number of axial ridges, which cut into the bushing when the grinding wheel is pressed on to the spindle bolt. As a result good security against relative rotation between the wheel and the spindle bolt is achieved. The spare grinding wheels are situated in a store associated with the spindle bolt, and a grinding wheel changing device is provided between the store and the spindle bolt. This device comprises an arm which is pivotable between a position in front of the spindle bolt and a position in front of the store, and is provied with a puller for the grinding wheel to be removed from the bolt, and a support for a spare grinding wheel. At the changing operations, the arm performs a number of movements according to a pre-determined sequence, whereby a new grinding wheel is taken from the store and is introduced into the support, the worn-out grinding wheel is pulled off the spindle bolt, and the new grinding wheel is pressed on to the spindle bolt from the support. Thereafter the arm returns to a neutral position.

Grinding wheel changing devices of this kind have a disadvantage in that the grinding wheel mounted on the spindle bolt is inadequately axially fixed.

The object of the present invention is to provide a device as defined in the introductory clause of the specification, in which changing of grinding wheels can be effected with simple means and with little time consumption, and in which the grinding wheel is firmly axially fixed and secured against rotation on the spindle bolt.

Figure 2:
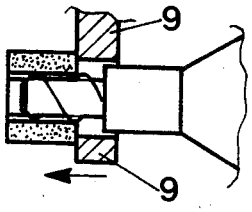
Figure 3:
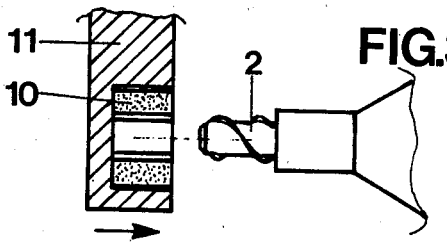
Figure 4:
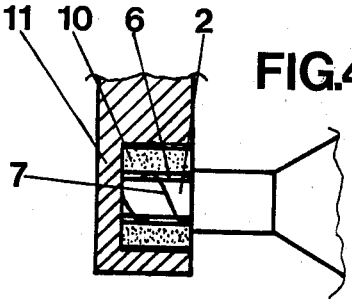

Further objects and advantages of the present invention will become more apparent from the more detailed description of the invention given below in connection to the annexed drawing, in which FIG. 1 shows the principles of the internal grinding operation, FIG. 2 shows the principle of removing a worn-out grinding wheel from the spindle bolt, and FIGS. 3 and 4 show the principle of mounting a new grinding wheel on the spindle belt.

In FIG. 1, a grinding spindle 1 is shown, comprising a spindle bolt 2 and a grinding wheel 3 mounted on the spindle bolt. The grinding wheel is shown in section. The grinding wheel is intended for grinding a bore in a work piece, e.g. a bore in a bearing ring 4, as shown in the figure. The work piece is rotatably fixed in the grinding position in a way known per se by suitable means 5, such as a chuck, a driving surface and a thrust plate. In order to introduce the grinding wheel into the grinding position in the ring 4, the spindle 1 and the means 5 are axially displaced in relation to each other. The grinding wheel is pressed on to the spindle bolt, and for achieving the desired security against relative rotation between the grinding wheel and the spindle bolt and for making it possible to pull the grinding wheel off the bolt, the bore of the grinding wheel is provided with a bushing 6 of plastic or another comparatively easily deformable material, and the envelope surface of the bolt is provided with a number of helical ridges 7, which contact and deform the plastic bushing 6. In order to avoid the risk of breaking the grinding wheel when the spindle bolt is introduced into the bushing, the cylindrical surface of the spindle bolt is dimensioned such that it has a loose fit in the bushing. The wall of the bore of the bushing is thus only contacted by the ridges 7. By choosing the helical shape for the ridges so that the bolt tends to be screwed into the bore of the bushing by the grinding force, the grinding wheel is always kept in a fixed position against the flange 8 of the spindle bolt.

When a pre-determined number of work pieces have been ground, and the grinding wheel has been sharpened down to a certain diameter, the grinding wheel is determined to be worn out. A puller 9 is then introduced into a position behind the grinding wheel. The puller suitably has the shape of a fork which straddles the spindle, as shown in FIG. 2. When a grinding operation is finished, e.g. when the spindle is moved to the right to give place for a new work piece, the puller is pressed against one of the end faces of the grinding wheel, as shown with an arrow, whereby the grinding wheel is pulled off the spindle bolt. Thereafter the grinding wheel can be disposed of, e.g. by falling down into a container for worn out grinding wheels. The puller is then removed from its active position. FIG. 3 shows the grinding spindle when the worn out grinding wheel is removed, and a new grinding wheel 10 in a support 11 in a position concentric to the spindle axis. The support 11 can be moved perpendicularly to the spindle axis as well as parallel to the spindle axis, so that the grinding wheel can be pressed on to the spindle bolt when the bore of the grinding wheel is situated in front of the spindle bolt. The last mentioned movement is shown by an arrow in the figure.

FIG. 4 shows the grinding wheel completely pressed on to the spindle bolt. When the mounting operation is finished, the support is removed and provided with a new grinding wheel, while the grinding spindle can resume the grinding operations according to FIG. 1.

During mounting of the spare grinding wheel 10 on the spindle bolt 2, the spindle and/or the grinding wheel are suitably freely rotatable when the spindle bolt is pressed into the bushing. During pressing of the spindle bolt into the bushing, the spindle bolt is thereby turned in relation to the grinding wheel because of the existence of the helical ridges 7 on the envelope surface of the spindle bolt. The ridges 7 are not cutting away any material in the bushing 6, but are only displacing the comparatively soft material in the course of the mounting procedure. The grinding wheel thus mounted is rigidly fixed against rotational movements in relation to the spindle bolt as well as against axial movements on same, but despite this fact it can be pulled off when being changed. In order to simplify the changing of the grinding wheels on the spindle bolt, the helix of the ridges 7 should have a comparatively great pitch. The pitch angle should suitably exceed 30°. On the other hand, in order to achieve a secure axial fixing of the grinding wheel on the spindle bolt, the pitch angle ought not to be too great, and is suitably less than 75°.

In order to achieve a desired position fixing and guidance of the grinding wheel on the spindle bolt, the spindle bolt is suitably provided with at least two ridges 7. If the pitch angle is great, it can suitably have three ridges.

I claim:

1. Grinding machine adapted for the rapid changing of grinding wheels on a grinding spindle bolt comprising a deformable bushing which is provided in a centrally located bore in said grinding wheel and adapted to receive said grinding spindle bolt, said spindle bolt having an external surface provided with at least one ridge helically arranged about said external surface, said ridge having a diameter exceeding the internal diameter of said bushing, the internal surface of said bushing being without grooves for receiving said ridges whereby said bushing is deformed by said ridges, said helix being pitched sufficiently greatly to enable assembly and disassembly of said wheel on said spindle bolt solely by axially directed forces.

2. Grinding machine according to claim 1, wherein said external surface of said spindle bolt fits in the bore of said bushing in said grinding wheel with a clearance fit such that when said grinding wheel is mounted on said spindle bolt, the bore wall of said bushing is contacted only by the ridge on said spindle bolt.

3. Grinding machine according to claim 1, wherein the spindle has a flange, and the helical shape of said ridge has a direction such that the grinding wheel tends to be screwed into and locked against said flange provided on said spindle by the grinding forces.

4. Grinding machine according to claim 1, wherein said pitch angle of said helix of said ridge is at least 30°.

5. Grinding machine according to claim 1, wherein said pitch angle of said helix of said ridge is less than 75°.

6. Grinding machine according to claim 1, wherein said spindle bolt is provided with at least two ridges.

7. Grinding machine according to claim 6, wherein said spindle bolt is provided with three ridges.

8. In a grinding wheel assembly including a grinding wheel having a central mounting hole, and a driving spindle insertable in the same hole for driving said wheel; the improvement wherein the outer surface of said spindle is formed with a cylindrical surface having helical ridges and said hole is lined with a bushing of easily deformable material, said bushing having an internal diameter less than the outer diameter of said ridge, but sufficiently great to enable the inserting of said spindle therein, and being free of preformed internal grooves for receiving said ridge, said ridges having a sufficiently great pitch to enable assembly and disassembly of said wheel on said spindle substantially solely by the application of axially directed forces on said wheel and spindle.

9. The grinding assembly of claim 8 wherein said bushing has an internal diameter to substantially engage only said ridges of said spindle.

10. The grinding assembly of claim 8 wherein said bushing has an internal diameter to fit said cylindrical surface with a clearance fit, said internal surface of said bushing having no helical grooves therein matching said ridges, whereby the material of said bushing is deformed by said ridges.

11. The grinding assembly of any of claims 8, wherein said helical ridges have a pitch between 30 and 75 degrees.

12. The grinding assembly of claim 8 wherein said bushing has no cut or preformed grooves in its internal surface matching said ridges, whereby the material of said bushing is deformed by said ridges.

* * * * *